US006094178A

United States Patent [19]

Sanford

[11] Patent Number: 6,094,178

[45] Date of Patent: Jul. 25, 2000

[54] DUAL MODE QUADRIFILAR HELIX ANTENNA AND ASSOCIATED METHODS OF OPERATION

[75] Inventor: Gary George Sanford, Apex, N.C.

[73] Assignee: Ericsson, Inc., Research Triangle Park, N.C.

[21] Appl. No.: 08/969,861

[22] Filed: Nov. 14, 1997

[51] Int. Cl.[7] ..... H01Q 1/36

[52] U.S. Cl. ..... 343/895; 343/860

[58] Field of Search ..... 343/895, 860

[56] References Cited

U.S. PATENT DOCUMENTS

| | | | |
|---|---|---|---|
| 5,138,331 | 8/1992 | Josypenko | 343/895 |
| 5,349,365 | 9/1994 | Ow et al. | 343/895 |
| 5,600,341 | 2/1997 | Thill et al. | 343/895 |
| 5,606,332 | 2/1997 | Darden, IV et al. | 343/790 |
| 5,635,945 | 6/1997 | McConnell et al. | 343/895 |
| 5,678,201 | 10/1997 | Thill | 455/89 |
| 5,828,348 | 10/1998 | Tassoudji et al. | 343/895 |

FOREIGN PATENT DOCUMENTS

| | | |
|---|---|---|
| 0 715369 | 5/1996 | European Pat. Off. . |
| WO97/11507 | 3/1997 | WIPO . |
| WO97/35356 | 9/1997 | WIPO . |
| WO98/28814 | 7/1998 | WIPO . |
| WO98/28816 | 7/1998 | WIPO . |

OTHER PUBLICATIONS

PCT International Search Report.

D.F. Bowman, Impedance Matching and Broadbanding, *Antenna Engineering Handbook*, (Ed. by H. Jasik, 1961 and R.C. Johnson, 1993).

C.C. Kilgus, Resonant Quadrifilar Helix Design, *The Microwave Journal*, Dec. 1970.

Dr. O.P. Leisten, A Combined Right Hand Circular and Linear Polarisation Antenna for GPS and Cellular Telephone Usage, Institute of Navigation Conference, Kansas City, Sep. 17–20, 1996.

Leisten, et al., *Performance of a Miniature Dielectrically Loaded Volute Antenna*, Institute of Navigation Conference, Palm Springs, Sep. 12–15, 1995, pp. 869–877.

F. Stefan Johansson, Mikael Ohgren, Invention Disclosure for *Dual Frequency Quadrifilar Helix Antenna*Saab Ericsson Space, Feb. 20, 1997.

*Primary Examiner*—Don Wong
*Assistant Examiner*—Shih-Chao Chen
*Attorney, Agent, or Firm*—Myers Bigel Sibley & Sajovec

[57] ABSTRACT

Antenna systems for transmitting electrical signals are provided which include a quadrifilar helix antenna. A first antenna feed is coupled to the quadrifilar helix antenna for exciting the radiating elements in phase quadrature. A second antenna feed is also coupled to the quadrifilar helix antenna for exciting the radiating elements in-phase. These antenna systems may be operated in either a helical radiation mode, where the antenna may be designed to radiate as a resonant quadrifilar helix antenna, or in a monopole radiation mode, where the antenna acts as the equivalent of a large monopole antenna. Additionally, the antenna systems may further include means for matching the impedance of the quadrifilar helix antenna to the impedance of either or both of the antenna feeds.

18 Claims, 5 Drawing Sheets

DUAL MODE QUADRIFILAR HELIX ANTENNA AND ASSOCIATED METHODS OF OPERATION

FIELD OF THE INVENTION

The present invention relates generally to antenna systems for radiotelephones, and, more particularly, to quadrifilar helix antenna systems for radiotelephones.

BACKGROUND OF THE INVENTION

Radiotelephones, which are well known in the art, generally refer to communications terminals which can provide a wireless communications link to one or more other communications terminals. Such radiotelephones are used in a variety of different applications, including terrestrial and satellite cellular telephone communications systems. In typical terrestrial cellular telephone systems, wireless transmissions from mobile users are received by local base stations or "cells" which retransmit the signal, via either a wireless link or the local telephone system, for reception by the intended receive terminals. In satellite "cellular" telephone systems, the satellite may either operate as the equivalent of a terrestrial local base station or, alternatively, may directly retransmit the signal to the intended receive terminal.

Many terrestrial cellular telephone systems rely primarily or exclusively on line-of-sight communications. In these systems numerous local cells are typically required to provide communications coverage for a large geographic area. The cost associated with providing such a large number of cells may prohibit the use of terrestrial cellular telephone systems in sparsely populated regions and/or areas where there is limited demand for cellular service. Moreover, even in areas where terrestrial cellular service is not precluded by economic considerations, "blackout" areas often arise due to local terrain and weather conditions.

In light of the above limitations with terrestrial based cellular telephone systems, combined terrestrial satellite communications networks have been proposed for providing cellular telephone service in regions which are not well suited for traditional terrestrial cellular systems. In these proposed systems, a limited terrestrial based cellular network is supplemented by a satellite communications network to provide communications for mobile users over a large geographical area. The terrestrial based cellular stations could thus be provided in high traffic areas, while a satellite communications network would provide service to remaining areas. In order to provide both cellular and satellite communications, the radiotelephones used with this system would typically include two transceivers, one for communicating with the terrestrial network and a second for communicating with the satellite. These combined cellular/satellite communications systems could provide full communications coverage over a wide geographic area without requiring an excessive number of terrestrial cells.

One such proposed terrestrial satellite cellular communications system is the Asian Cellular Satellite System. In this system, the satellite network will be implemented as one or more geosynchronous satellites orbiting approximately 22,600 miles above the equator that provide spot beam coverage over much of the far east, including China, Japan, Indonesia and the Philippines. In this system, signals transmitted to the satellite will fall within the 1626.5 MHz to 1660.5 MHz transmit frequency band, and signals transmitted from the satellite will fall within the 1525 MHz to 1559 MHz receive frequency band. Terrestrial cellular communications may then be implemented as a standard AMPS network, which operates in the 824 MHz to 894 MHz frequency band, or as a GSM network which operates in the 890 MHz to 960 MHz frequency band.

While integrating satellite and cellular service together in a dual-mode system may overcome many of the disadvantages associated with exclusively terrestrial based cellular systems, providing dual-mode radiotelephones that meet consumer size, weight, cost, and performance expectations is a significant challenge. These consumer expectations have been defined by the radiotelephones used with conventional terrestrial cellular systems, which only include a single transceiver which is designed to communicate with a cellular node which typically is located less than 20 miles from the mobile user. By way of contrast, the handheld radiotelephones which will be used with the Asian Cellular Satellite System must include both a terrestrial cellular and a satellite transceiver. Moreover, the large free space loss associated with the satellite communications aspect of the system may significantly increase the power and antenna gain which must be provided by the antenna for the satellite transceiver on the radiotelephone, as the signals transmitted to or from the satellites undergo a high degree of attenuation in traveling the 25,000 or more miles that typically separates the radiotelephone from the geosynchronous satellites.

Furthermore, the satellite aspects of the network also may impose additional constraints on the handheld user radiotelephone. For instance, the satellite transceiver on the radiotelephone preferably should provide a quasi-hemispherical antenna radiation pattern (in order to avoid the need to track a desired satellite) as opposed to the doughnut-shaped radiation pattern which is typically preferred for terrestrial cellular applications. Additionally, when communicating with the satellite, the radiotelephone should transmit and receive a circularly polarized waveform, so as to minimize the signal loss resulting from misalignment of the satellite and radiotelephone antennas and to avoid the effects of Faraday rotation which may result when the signal passes through the ionosphere. Conversely, when communication with terrestrial base stations, the radiotelephone will typically need to operate with a linear polarization.

In light of the above constraints, there is a need for handheld radiotelephones, and more specifically, antenna systems for such radiotelephones, which are capable of meeting the dual radiation pattern, operating frequency and polarization requirements mandated by combined terrestrial/satellite cellular communications networks. Moreover, given the handheld nature of the user terminals and consumer expectations of an antenna which is conveniently small for ease of portability, the antenna system capable of meeting the aforementioned requirements should fit within a small physical volume.

SUMMARY OF THE INVENTION

In view of the above limitations associated with existing antenna systems for radiotelephones, it is an object of the present invention to provide radiotelephone antenna systems which provide radiation patterns suitable for both terrestrial and satellite communication systems.

Another object of the present invention is to provide radiotelephone antenna systems which may operate in at least two separate frequency bands and which are capable of providing a good impedance match over each such frequency band of operation.

It is still a further object of the present invention to provide radiotelephone antenna systems which are sufficiently small to be employed with modern, handheld cellular telephones.

Additional objects, features and advantages of the present invention will become apparent upon reading the following detailed description and appended claims and upon reference to the accompanying drawings.

These and other objects of the present invention are provided by physically small quadrifilar helix antenna systems which can be excited to radiate in two different modes. In the first such mode (the "helical radiation mode"), the radiating elements of the quadrifilar helix antenna are fed in phase quadrature. In this mode, the antenna may be operated as a circularly polarized, resonant quadrifilar helix antenna, with an overhead radiation pattern suitable for satellite communications applications. Alternatively, the radiating elements of the quadrifilar helix antenna may be fed identical signals, thereby causing the antenna to operate as the equivalent of a large, linearly polarized monopole antenna with a doughnut shaped radiation pattern suitable for terrestrial cellular telephone applications (the "monopole radiation mode"). Thus, according to the teachings of the present invention, physically small radiotelephone antenna systems are provided which are capable of operating with both terrestrial and satellite cellular communications systems.

In a preferred embodiment of the present invention, an antenna system for transmitting electrical signals is provided which includes a quadrifilar helix antenna having four radiating elements. A first antenna feed is coupled to the quadrifilar helix antenna for exciting the radiating elements in phase quadrature, and a second antenna feed is also coupled to the quadrifilar helix antenna for exciting the radiating elements in-phase. The quadrifilar helix antenna operates in a helical radiation mode when excited by the first antenna feed and operates in a monopole radiation mode when excited by the second antenna feed. The antenna system may further include four reactances which electrically connect the origin of each of the radiating elements to a common node such that the potential at this node is zero when a signal is provided to the quadrifilar helix antenna via the first antenna feed.

In another aspect of the present invention, means are provided for matching the impedance of the quadrifilar helix antenna to the impedance of the first antenna feed when the antenna is operated in the helical radiation mode. Such matching means may be implemented as a reactive network coupled to each of the radiating elements of the quadrifilar helix antenna. In one specific embodiment, these matching means comprise an inductance coupled in series with each radiating element and a capacitance coupled in parallel with each radiating element. Similarly, the antenna system may also include means for matching the impedance of the quadrifilar helix antenna to the impedance of the second antenna feed when the antenna is operated in the monopole radiation mode. In one embodiment of the present invention, such means comprise a first capacitance coupled in parallel to the second antenna feed and a second capacitance coupled in series with the second antenna feed.

The quadrifilar helix antenna systems according to the present invention may further include a microelectronic substrate, on which the quadrifilar helix antenna, the first antenna feed and the second antenna feed are implemented. Moreover, these antenna systems may be implemented in combination with a radiotelephone having a transmitter, a receiver and a user interface.

In another embodiment of the present invention, methods are provided for transmitting electrical signals using a quadrifilar helix antenna by exciting the quadrifilar helix antenna in a helical radiation mode and by exciting the quadrifilar helix antenna in a monopole radiation mode. This may be accomplished by coupling a first antenna feed to the quadrifilar helix antenna for exciting the radiating elements in phase quadrature and by coupling a second antenna feed to the antenna for exciting the radiating elements in-phase. Additionally, these methods may further comprise the steps of matching the impedance of the quadrifilar helix antenna to the impedance of the first antenna feed when operating in the helical radiation mode and means for matching the impedance of the quadrifilar helix antenna to the impedance of the second antenna feed when operating in the monopole radiation mode.

Thus, pursuant to the teachings of the present invention, relatively small, dual mode antenna systems for radiotelephones are provided that are suitable for use in both terrestrial and satellite cellular communications networks. This dual mode operating capability is achieved by providing feed mechanisms suitable for exciting a quadrifilar helix antenna in both a helical radiation mode and in a monopole radiation mode.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Additionally, it will be understood by those of skill in the art that the present invention may be advantageously used in a variety of applications, and thus the present invention should not be construed as limited in any way to the example applications described herein. Like numbers refer to like elements throughout.

Figure 1:
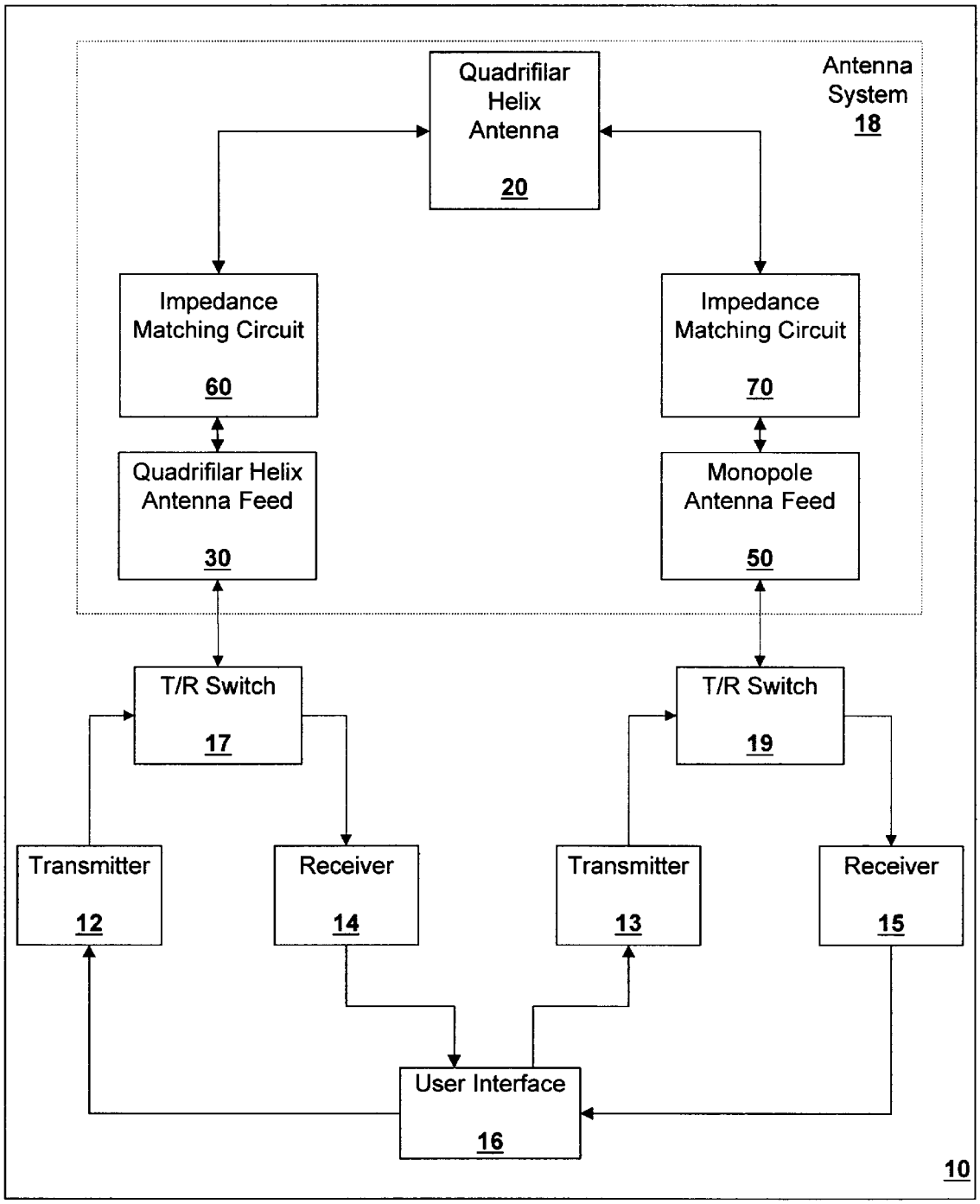
FIG. 1 is a block diagram of a dual-mode radiotelephone which includes an antenna system according to the present invention.

An embodiment of a dual mode radiotelephone 10 which includes an antenna system 18 according to the present invention is depicted in the block diagram of FIG. 1. As shown in FIG. 1, radiotelephone 10 typically includes a transmitter 12, a receiver 14, a user interface 16, a transmit/receive ("T/R") switch 17 and an antenna system 18. As is well known to those of skill in the art, transmitter 12 converts the information which is to be transmitted by radiotelephone 10 into an electromagnetic signal suitable for radio communications, and receiver 14 demodulates electromagnetic signals which are received by radiotelephone 10 so as to provide the information contained in the signals to user interface 16 in a format which is understandable to the user. A wide variety of transmitters 12, receivers 14, user interfaces 16 (e.g., microphones, keypads, rotary dials) and T/R switch 17 which are suitable for use with handheld radiotelephones are known to those of skill in the art, and such devices may be implemented in radiotelephone 10.

In a preferred embodiment of the present invention, radiotelephone 10 is designed to operate with both terrestrial cellular communications networks which operate in a first frequency band, and with satellite communications networks which operate in a second frequency band which may be the same as the first frequency band or may be different from the first frequency band. As will be understood by those of skill in the art, transmitter 12 and receiver 14 may be designed to transmit and receive signals in both the first and second frequency bands, or alternatively, as illustrated in FIG. 1, two transmitters 12, 13 and two receivers 14, 15 may be provided (along with T/R switch 19), with transmitter-receiver 12, 14 dedicated to satellite communications and the second transmitter-receiver 13, 15 dedicated to terrestrial communications.

As illustrated in FIG. 1, antenna system 18 comprises a quadrifilar helix antenna 20 and first and second antenna feeds 30, 50. Additionally, antenna system 18 may further include first and/or second impedance matching circuits 60, 70, which serve to better match the impedance of quadrifilar helix antenna 20 (which typically differs depending upon how antenna 20 is fed) to the impedance of first and second antenna feeds 30, 50, respectively. In the embodiment illustrated in FIG. 1, antenna feed 30 couples signals (through switch 17) between satellite communications transmitter-receiver 12, 14 and quadrifilar helix antenna 20, while antenna feed 50 couples signals (through switch 19) between terrestrial communications transmitter-receiver 13, 15 and quadrifilar helix antenna 20.

In a preferred embodiment of the present invention, antenna feed 30 excites quadrifilar helix antenna 20 so that it operates in a helical radiation mode. In this mode of operation, the antenna may be excited as a traditional quadrifilar helix antenna so as to transmit and receive circularly polarized signals while providing an overhead radiation pattern suitable for satellite communications applications. Additionally, second antenna feed 50 is provided for exciting antenna 20 so that it operates in a monopole radiation mode. In this mode, the antenna is excited so as to radiate as a linearly polarized monopole antenna with a doughnut-shaped radiation pattern which is suitable for terrestrial cellular telephone applications. Moreover, the monopole radiation mode is orthogonal to the helical radiation mode and thus operation of antenna 20 in the monopole radiation mode does not compromise the primary radiating characteristics of quadrifilar helix antenna 20 when operated in its helical radiation mode. Accordingly, pursuant to the teachings of the present invention, an antenna 20 is provided which may be excited as either a resonant quadrifilar helix antenna or as a monopole antenna.

As indicated in FIG. 1, antenna 20 is a quadrifilar helix antenna. A helix antenna refers to a class of relatively small antennas which comprise a conducting member wound in the form of a screw thread to form a helix. These antennas are well suited for a number of applications, including applications requiring circularly polarized waveforms and an overhead, quasi-hemispherical beam pattern. A quadrifilar helix antenna is a helix antenna which includes four orthogonally disposed helical radiating elements which are excited in phase quadrature (i.e., the energy induced into or from the individual radiating elements is offset by 90° between adjacent radiating elements).

Figure 2:
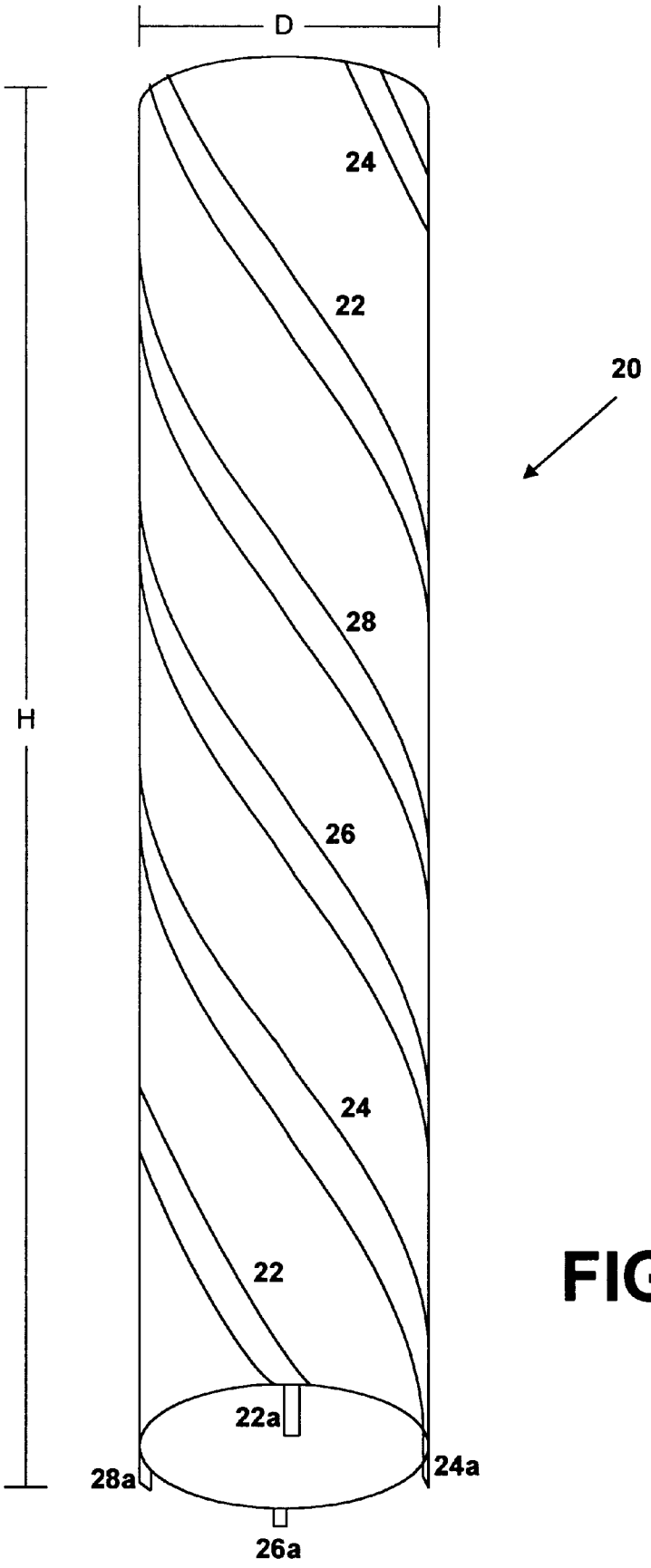
FIG. 2 is a perspective view of a quadrifilar helix antenna.

FIG. 2 illustrates one embodiment of a quadrifilar helix antenna 20 implemented according to the present invention. As illustrated in FIG. 2, antenna 20 is comprised of four radiating helical antenna elements 22, 24, 26, 28. In a preferred embodiment, the elements 22, 24, 26, 28 of quadrifilar helix antenna 20 are physically spaced from each other by 90° and are each wrapped in a helical shape along the length of a coaxial supporting tube, thereby defining a cylinder of constant diameter D and axial length H. However, alternative embodiments within the scope of the present invention include quadrifilar helix antennas 20 having radiating elements 22, 24, 26, 28 which are helical in the sense that they each form a coil or part coil around an axis, but also change in diameter from one end to the other thus defining instead a conical envelope or other surface of revolution. Moreover, note that as used herein, it is intended that the word "helix" not imply a plurality of turns. In particular, a "helix" as used herein may constitute less than one full turn.

The elements 22, 24, 26, 28 of quadrifilar helix antenna 20 are typically implemented as a wire or strip of conductive material. As illustrated in FIG. 2, in a preferred embodiment, elements 22, 24, 26, 28 each comprise a continuous strip of electrically conductive material such as copper that is printed on a flexible, planar microwave dielectric substrate such as fiberglass, TEFLON, polyimide or the like via etching, deposition or other conventional methods. This flexible dielectric base is then rolled into a cylindrical shape, thereby converting the linear strips into helical antenna elements 22, 24, 26, 28. However, while the technique of forming a quadrifilar helix antenna described above is preferred for certain applications, it will be readily apparent to those of skill in the art that quadrifilar helix antenna 20 may be implemented in a variety of different ways, and that a cylindrical support structure is not even required.

Quadrifilar helix antenna 20 may additionally include a radome. In the preferred embodiment, this radome is a plastic tube with an end cap.

The radiation pattern provided by quadrifilar helix antenna 20 is primarily a function of the helix diameter (D), pitch angle (which is a function of the number of turns per unit axial length of the helix) and element lengths. In a preferred embodiment of the present invention, the helical antenna elements 22, 24, 26, 28 are each approximately $\lambda/4$, $\lambda/2$, $3\lambda/4$ or $\lambda$ in electrical length (or any other length which will provide for resonance operation), where $\lambda$ is the wavelength corresponding to the center frequency of the frequency band in which the satellite communications aspect of the network operates. Designed in this manner, quadrifilar helix antenna 20 will operate at resonance when connected to quadrifilar helix antenna feed 30 in the frequency band corresponding to the satellite communications system network. Moreover, as will be understood by those of skill in the art, the actual physical length of the antenna, need not be a multiple of a quarter-wavelength, but instead may be appreciably shortened by radome or other effects that change the velocity of propagation such that the element lengths are effectively shorter than in free space. Such an effect is advantageous where smaller size is an important goal, and thus it will be understood that quadrifilar helix antenna systems of the present invention may also be operated at or near resonance with antenna elements of physical lengths other than multiples of a quarter-wavelength.

Moreover, while quadrifilar helix antennas with elements of actual or electrical (where radome effects apply) length $\lambda/4$, $\lambda/2$, $3\lambda/4$ and $\lambda$ are known to operate at resonance, such resonant or near resonant operation may also be obtained with elements of other lengths. Resonant operation implies that the equivalent reactance is zero while the equivalent immittance is a real value. Operation at resonance is desirable, because at resonance maximum power transfer may be accomplished without any further reactive matching. However, as will be understood by those of skill in the art, through the use of additional matching means it is possible to design a quadrifilar helix antenna with element lengths which are not a multiple of a quarter wavelength that operates at or near resonance, thereby providing for good power transfer between the source and the load. Accordingly, it should be recognized that the present invention is not limited to quadrifilar helix antennas with physical or electrical element lengths which are multiples of a quarter wavelength, but instead encompasses quadrifilar helix antennas with any element lengths which, in conjunction with any matching structure, provide for nearly resonant operation.

As illustrated in FIG. 2, the four individual antenna elements 22, 24, 26, 28 that comprise quadrifilar helix antenna 20 each have an origin (which is adjacent "feed points" 22*a*, 24*a*, 26*a*, 28*a*) and a distal end. As will be understood by those of skill in the art, the distal ends of antenna elements 22, 26 and 24, 28 may be joined to form a closed loop quadrifilar helix antenna comprised of two bifilar loops 22, 26 and 24, 28, or, alternatively, the distal end of antenna elements 22, 24, 26, 28 may be left open circuited to form an open loop quadrifilar helix antenna. In a preferred embodiment of the present invention, a closed loop quadrifilar helix antenna 20 is used if the electrical length of the antenna elements 22, 24, 26, 28, are $\lambda/2$ or $\lambda$, while an open loop design is used for antennas 20 having radiating elements 22, 24, 26, 28 of electrical length $\lambda/4$, or $3\lambda/4$, as these designs facilitate matching the impedance of quadrifilar helix antenna to the impedance of antenna feeds 30, 50.

As is well known, quadrifilar helix antennas can be operated in several modes, including axial mode, normal mode or a proportional combination of both modes, each of which provides a different type of radiation pattern. Those of skill in the art will understand, in light of the present disclosure, that the invention described herein is not limited to any particular mode of quadrifilar helix antenna operation, as the mode of operation is primarily dependent on the physical characteristics of the antenna as opposed to the specific feed mechanism. However, in a preferred embodiment of the present invention, quadrifilar helix antenna 20 is designed to operate in either normal mode or proportional mode so that antenna 20, when excited in helical radiation mode, provides a circularly polarized, quasi-hemispherical radiation pattern which is suitable for mobile satellite communications.

Figure 4:
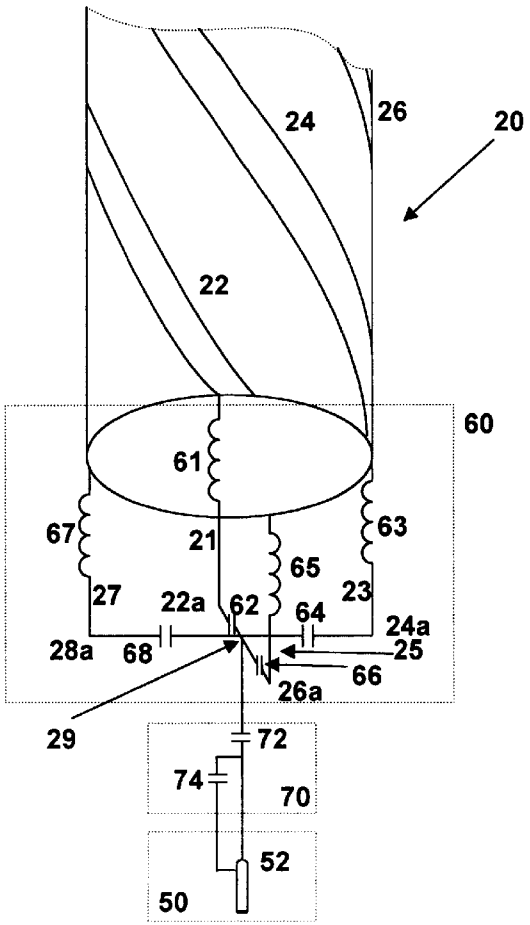
FIG. 4 is a perspective view of a quadrifilar helix antenna according to the present invention which illustrates a preferred embodiment of the antenna feeds and impedance matching networks.

FIGS. 2 and 4 also depict the connections via which the feed networks 30, 50 may be coupled to quadrifilar helix antenna 20. As is best illustrated in FIG. 4, each of the elements 22, 24, 26, 28 of quadrifilar helix antenna 20 may be connected to the quadrifilar helix antenna feed 30 via short conductors 21, 23, 25, 27. These conductors 21, 23, 25, 27 may be used to connect each feed point 22*a*, 24*a*, 26*a*, 28*a* to a common node 29 through capacitors 62, 64, 66, 68 (or other reactive components). In the preferred embodiment, common node 29 is located along the central axis of quadrifilar helix antenna 20. Conductors 21, 23, 25, 27 may be formed of any conductive material such as copper, and may be a conductive wire, strip, transmission line or the like. As will be understood by those of skill in the art, the means for implementing conductors 21, 23, 25, 27 may be selected so as to create an intentional inductance in series with each of the radiating elements 22, 24, 26, 28 that aids in matching the impedance of antenna 20 with the impedance of the quadrifilar helix antenna feed 30, or alternatively, these conductors may simply serve as a connection to common node 29.

Figure 3:
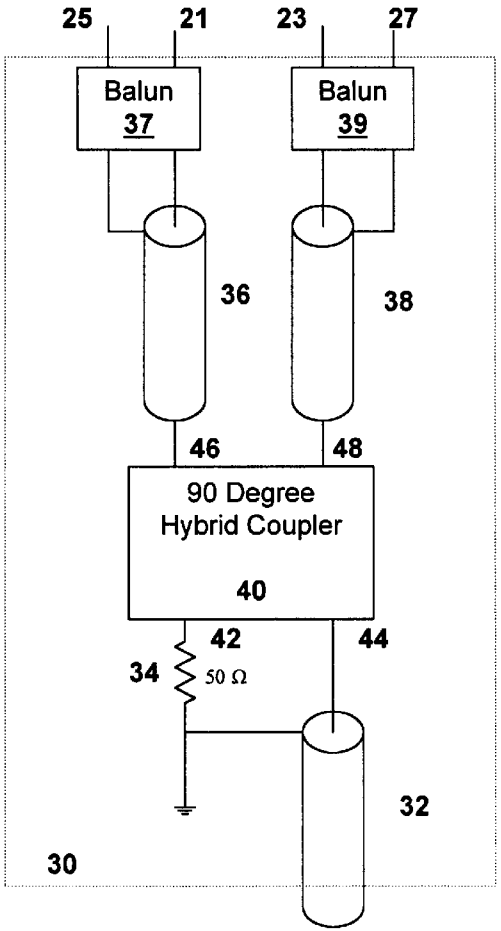
FIG. 3 is a circuit diagram depicting a preferred embodiment of the antenna feed for the helical radiation mode of operation.

In a preferred embodiment of the present invention, antenna feed 30 is coupled to quadrifilar helix antenna 20 via the short conductors 21, 23, 25, 27 illustrated in FIG. 4. FIG. 3 illustrates this embodiment of the quadrifilar helix antenna feed structure 30 in more detail. As shown in FIG. 3, antenna feed 30 may be comprised of an input coaxial transmission line 32, a 90° 3 dB hybrid coupler 40, a 50 Ω resistor 34, output coaxial transmission lines 36, 38 and baluns 37, 39. As illustrated in FIG. 3, 90° hybrid coupler 40 has four ports, input ports 42, 44 and output ports 46, 48. In the embodiment depicted in FIG. 3, input 44 is coupled to one of the conductors which comprises transmission line 32 and input 42 is coupled to a reference voltage such as ground or a "0" potential plane through 50 Ω resistive termination 34. The 90° hybrid coupler 40 then divides the input signal incident at port 44 into two, equal amplitude, output signals at ports 46 and 48, which are offset from each other by 90° in phase.

As will be understood by those of skill in the art, to operate in the helical radiation mode, the signal incident on radiating elements 22, 24, 26, 28 need not have exactly identical amplitude, nor is it necessary that the phase offset between each radiating element 22, 24, 26, 28 be exactly 90°. In fact, in most practical embodiments the amplitude of the signals incident on each of the radiating elements 22, 24, 26, 28 may vary by as much as 5%, and the phase difference between elements typically is in the range of 85° to 95°. Moreover, even wider amplitude and phase variations may be acceptable in certain applications, depending primarily upon the radiation pattern requirements of the communications system when operating in helical radiation mode. However, in a preferred embodiment of the present invention, the signals incident on each of the radiating elements 22, 24, 26, 28 have amplitudes which differ by less than 2% and have phase offsets that are between 87° and 93°.

In FIG. 3, the coaxial transmission lines 32, 36, 38 are depicted as coaxial cables. However, as will be understood by those of skill in the art, coaxial transmission lines 32, 36, 38 may be any conventional form of transmission line. In a preferred embodiment of the present invention, these transmission lines are implemented as microstrip transmission lines.

As will also be readily understood by those of skill in the art, 90° hybrid coupler 40 can be implemented in a variety of different ways. In a preferred embodiment of the present invention, 90° hybrid coupler 40 is implemented as a lumped element 90° hybrid splitter/combiner which is mounted on a stripline or microstrip electronic substrate. Such lumped element devices are preferred because they are small.

As illustrated in FIG. 3, transmission lines 36, 38 are coupled to baluns 37, 39, respectively. These baluns divide the outputs 46, 48 of 90° hybrid coupler 40 yet again producing a total of four outputs, all of which are in phase quadrature. These baluns 37, 39 could be implemented as any of numerous circuits commonly used for this purpose, including those listed in Richard C. JohnsonAntenna Engineering Handbook 3$^{rd}$ Edition, 1993.

As discussed above, according to the teachings of the present invention, quadrifilar helix antenna 20 may also be excited to operate in a monopole radiation mode, via use of the second or "monopole" antenna feed network 50. The details of a preferred embodiment of this feed network are depicted in FIG. 4. As is illustrated in FIG. 4, antenna feed network 50 may simply comprise a coaxial or microstrip transmission line 52 which is coupled to quadrifilar helix antenna 20 at common node 29. In this manner when a signal from transmission line 52 excites antenna 20 at common node 29, equal amplitude, in-phase voltages are applied to each of radiating elements 22, 24, 26, 28 and antenna 20 operates as a single, large monopole conductor.

As will be understood by those of skill in the art in light of the present disclosure, the bandwidth over which quadrifilar helix antenna 20 may effectively operate, when operating in either the helical or the monopole radiation modes, may be limited by power transfer considerations. Specifically, in operation, it is necessary to transfer electrical signals between transmitter-receiver pairs 12, 14 and 13, 15 and quadrifilar helix antenna 20. However, such power transfer typically is not lossless due to reflections which arise as a result of imperfect impedance matching between the source and the load. If large enough, the reflected power loss, which may be expressed in terms of voltage standing wave ratio ("VSWR"), may prevent the communications system from meeting its link budgets.

As is best illustrated in FIG. 3, typically, the electrical connection between transmitter-receiver pairs 12, 14 and 13, 15 and antenna feed networks 30 and 50 comprises a coaxial cable or microstrip transmission line. As such transmission lines typically exhibit an impedance of approximately 50 ohms, it is preferable that the impedance seen at the origin of antenna 20 also be on the order of 50 ohms so that energy transfer between antenna 20 and transmitter-receiver pairs 12, 14 and 13, 15 is maximized. Such matching can typically be accomplished by impedance matching network which transforms the impedance seen at the origin of antenna 20 to approximately 50 ohms.

As illustrated in FIG. 1, in a preferred embodiment of the present invention, impedance matching means 60, 70 are provided for matching the impedance of quadrifilar helix antenna 20 to the impedance of either one or both of the antenna feeds 30, 50. As will be understood by those of skill in the art, the impedance seen at the origin of antenna 20 varies depending upon the mode (helical or monopole) in which the antenna is excited. Moreover, while it is preferable that the impedance of the source and load are matched exactly, such an exact match is not required in many cases as the system link budgets typically do not require nearly lossless transfer between antenna 20 and antenna feeds 30, 50. Thus, impedance matching networks 60, 70 need only provide sufficient impedance matching such that the bandwidth and power transfer requirements associated with the particular communications system may be met.

The details of a preferred embodiment of the impedance matching circuit 60 are depicted in FIG. 4. As illustrated in FIG. 4, impedance matching circuit 60 may be provided to match the impedance of quadrifilar helix antenna 20 to the impedance of antenna feed 30 (not shown in FIG. 4). In this embodiment, the impedance of antenna 20 is transformed from its natural level to approximately 50 ohms by adding an inductive reactance 61, 63, 65, 67 in series to each radiating element 22, 24, 26, 28 and by adding a capacitive susceptance 62, 64, 66, 68 in shunt with each feed point 22*a*, 24*a*, 26*a*, 28*a*. Note that, as discussed above, the series inductances 61, 63, 65, 67 can be implemented as a lumped element device. However, in a preferred embodiment, series inductances 61, 63, 65, 67 are implemented in the transmission line comprising conductors 21, 23, 25, 27 or by slightly extending the length of the radiating elements 22, 24, 26, 28. Note that in this embodiment it is possible to match antenna 20 to quadrifilar helix antenna feed circuit 30 with nothing more than shunt capacitors 62, 64, 66, 68.

As discussed above, susceptances 62, 64, 66, 68 may be implemented in parallel at feed points 22*a*, 24*a*, 26*a*, 28*a* by connecting each susceptance between its respective short conductor 21, 23, 25, 27 and its transmission line reference voltage (ground). As illustrated in FIG. 4, a novel method of providing these shunt susceptances is to implement them as lumped element devices between each of the respective feed points 22*a*, 24*a*, 26*a*, 28*a* and common node 29 on the central axis of the helix. This implementation is possible because when antenna 20 is fed in helical radiation mode by antenna feed network 30, equal and opposite voltages are present on conductors 21, 23, 25, 27 and thus the potential sums to zero at common node 29 which is the feed point for exciting antenna 20 in the monopole radiation mode. Thus, in this implementation, the monopole feed network 50 is orthogonal to the quadrifilar helix antenna feed network 30 and hence a signal incident from antenna feed 30 will not generally couple into monopole antenna feed 50.

Moreover, this orthogonal relationship between antenna feeds 30 and 50 is equally applicable when antenna 20 is excited by monopole feed 50. Specifically, when a voltage is applied at common node 29 by monopole feed 50, the signal does not couple into quadrifilar helix antenna feed 30, but instead excites antenna 20 as a single large monopole conductor. As illustrated in FIG. 4, when fed in this manner, shunt susceptances 62, 64, 66, 68 are in parallel with each other and serve to connect the single large conductor to the monopole feed point (common node 29) in series. Thus antenna 20 radiates as a monopole antenna with a series reactance at the feed point.

In many cases, the impedance match between antenna 20 and monopole feed network 50 will also not be optimum. This is particularly true as the length of radiating elements 22, 24, 26, 28 and the value of reactive components 61, 63, 65, 67 and susceptive components 62, 64, 66, 68 are typically chosen to optimize the operation of antenna 20 when excited to radiate in a helical radiation mode. Accordingly, a second impedance matching circuit 70 may also be provided for matching the impedance of antenna 20 and monopole feed 50. As shown in FIG. 4, in a preferred embodiment, impedance matching network 70 may be implemented as a first capacitance 72 coupled in series to the inner conductor of transmission line 52 and a second capacitance 74 which is coupled in shunt to the outer conductor of transmission line 52.

While impedance matching circuits 60 and 70 may be used to advantageously match the impedance of antenna 20 to the impedance of antenna feeds 30 and 50, respectively, thereby facilitating the maximization of power transfer between the antenna and the transmitter(s) and receiver(s), these impedance matching networks may also be used to increase the bandwidth of the antenna in both frequency bands of operation. Accordingly, pursuant to the teachings of the present invention, the actual values of the reactive components in the matching circuits 60, 70 should be selected to optimize the power transfer characteristics over the full range of frequencies at which antenna 20 is to operate. Moreover, while the impedance matching networks 60, 70 depicted in FIG. 4 may be preferred in various applications, those of skill in the art will understand that a wide variety of impedance matching networks 60, 70 may be used to improve the broadband performance of antenna system 18, and thus the present invention is not limited to the matching networks 60, 70 depicted in FIG. 4.

As discussed above, antenna 20 may be operated in a monopole radiation mode in a first frequency band, and in a helical radiation mode in a second frequency band. Moreover, as the antenna systems 18 of the present invention are designed to have different feed points for the monopole and helical radiation modes, which are naturally orthogonal to each other, a diplexer or other means for dividing signals is not required. Thus, according to the teachings of the present invention antenna system 18 may operate in both the helical and monopole radiation modes in the same frequency band, so that the above-mentioned "first" and "second" frequency bands are the same, as opposed to separate, frequency bands.

Figure 5:
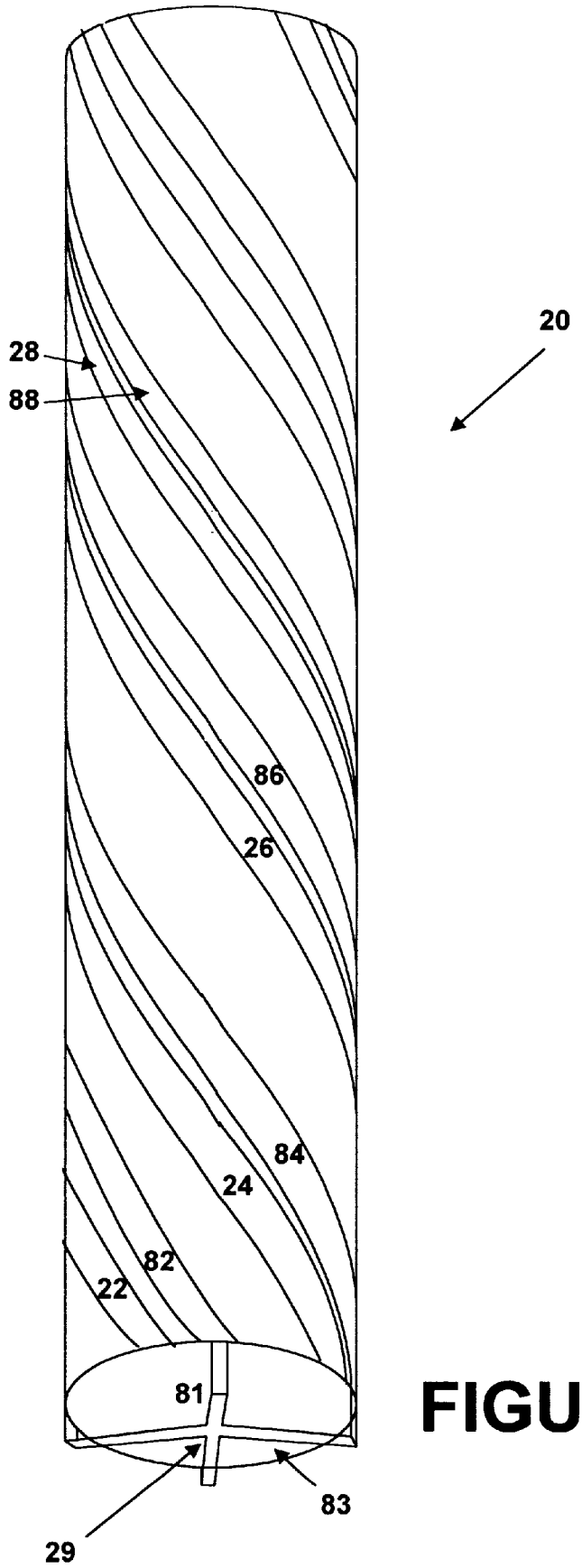
FIG. 5 is a perspective view of an alternative embodiment of a quadrifilar helix antenna according to the present invention.

As discussed above, in one embodiment of the present invention, shunt susceptances 62, 64, 66, 68 are implemented as non-radiating structures such as lumped components or transmission line components. However, in an alternative variation of the present invention, these shunt susceptances 62, 64, 66, 68 may be implemented as a radiating structure. One such embodiment of antenna system 18 is depicted in FIG. 5. As shown in the FIG. 5, shunt susceptances 62, 64, 66, 68 are implemented as four helical radiating elements 82, 84, 86, 88, which are shorted at their respective origins by cross-members 81, 83. Energy incident on quadrifilar helix antenna 20 is coupled between radiating elements 22, 24, 26, 28 and at least the closest of radiating elements 82, 84, 86, 88 to form the equivalent of a resonant circuit in parallel with quadrifilar helix antenna feed circuit 30. Moreover, once again common node 29 is at zero potential when antenna 20 is fed in the helical radiation mode, and thus the monopole feed circuit 50 depicted in FIG. 4 may be used to drive the antenna depicted in FIG. 5 in monopole radiation mode. In a preferred embodiment of the variation depicted in FIG. 5, antenna elements 22, 24, 26, 28 are slightly longer than elements 82, 84, 86, 88.

Figure 6:
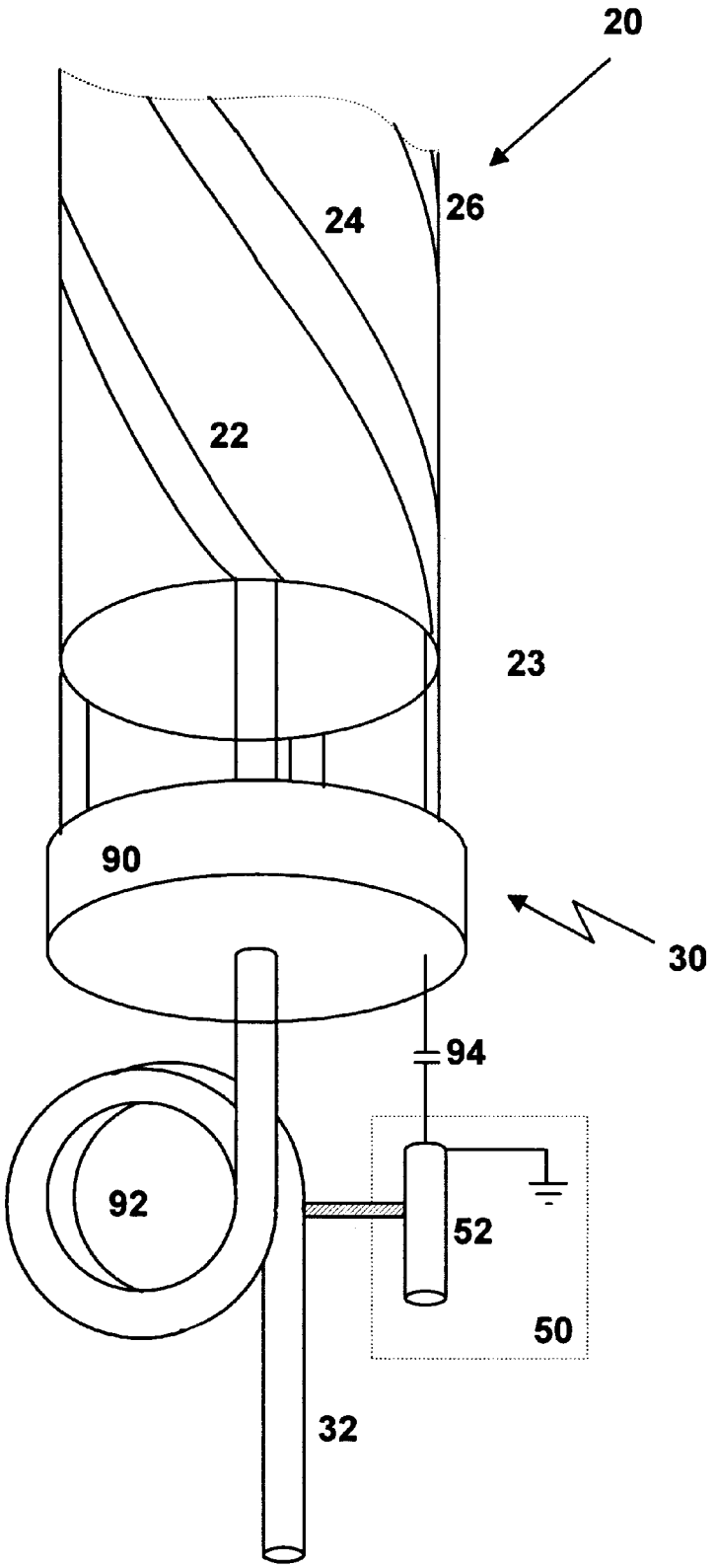
FIG. 6 is a perspective view of an alternative embodiment of the antenna system according to the present invention.

Another embodiment of the present invention is depicted in FIG. 6. In this embodiment, the circuitry which comprises antenna feed 30 includes a conductive surface, which is shown here as a small box 90 which provides a voltage reference (ground reference) for antenna feed 30. As is also illustrated in FIG. 6, the coaxial monopole feed 52 may be connected directly to the conductive box 90. In this arrangement, monopole feed 50 is connected to the radiating elements 22, 24, 26, 28 via the conductive box 90. Thus in this embodiment, the impedance between the radiating elements 22, 24, 26, 28 and the ground reference of helix feed 30 is incorporated as a series element (instead of as a shunt element as in the previously described embodiments) in monopole feed 50.

The feed arrangement disclosed in FIG. 6 may be preferable in certain applications where it is more difficult to match antenna 20 to monopole feed 50 due to the reactive loading of monopole feed 50 by the components (and the baluns 37, 39 in particular) in quadrifilar helix feed 30. Specifically, by incorporating the components of quadrifilar helix feed 30 as a series element, the effect of this impedance is much smaller on monopole feed 50.

For example, the actual impedance of the monopole radiation mode when fed this way is typically fairly large, for example, on the order of 50–j120 ohms. In the embodiment depicted in FIG. 6, this impedance may be matched by connecting 0.015 mhos of inductive susceptance in parallel with this impedance and 120 ohms of capacitive reactance in series. At 900 MHz, the inductive susceptance may be implemented as a 12 nH inductor 92 and the capacitive reactance may be implemented as a 1.4 pF capacitor 94.

Moreover, while those of skill in the art will understand that various other matching networks will be effective, the specific matching strategy discussed above may be advantageous in certain applications as the inductive susceptance can be formed in the coaxial quadrifilar helix antenna feed 32. As illustrated in FIG. 6, this may be accomplished by connecting the outer conductor of transmission line 52 to the outer conductor of transmission line 32. This implementation can provide as much as twice the useable bandwidth in the monopole mode of operation.

In a preferred embodiment of the present invention, the components of antenna feed networks 30, 50 and any impedance matching networks 60, 70 are all implemented as either transmission line or as surface mount components on a stripline or microstrip printed circuit board. On one side of the printed circuit board, four contacts may be provided to couple the radiating elements 22, 24, 26, 28 of quadrifilar helix antenna 20 to the feed circuits 30, 50 by way of matching circuits 60, 70. On the other side of the printed circuit board, provision may be made for attaching the coaxial transmission lines 32, 52 from transmitter-receiver pairs 12, 14 and 13, 15. The circuit may advantageously be arranged to fit completely within the cylindrical structure which houses quadrifilar helix antenna 20, thereby minimizing the volume required to house antenna system 18. In an alternative embodiment, the components may be implemented on the same planar flexible substrate on which antenna elements 22, 24, 26, 28 are implemented.

In another aspect of the present invention, methods of transmitting electrical signals using quadrifilar helix antenna 20 are disclosed. According to this aspect of the invention, antenna 20 may be excited in either a helical radiation mode or in a monopole radiation mode. Specifically, a first "quadrifilar helix" antenna feed 30 is provided that operates to excite the radiating elements 22, 24, 26, 28 of quadrifilar helix antenna 20 in phase quadrature, while a second "monopole" antenna feed 50 is provided that operates to excite the radiating elements 22, 24, 26, 28 in-phase. In this manner, antenna 20 may be operated in either a helical radiation mode (and in particular, as a resonant quadrifilar helix antenna) or in a monopole radiation mode simply by choosing which feed to excite.

In a preferred embodiment of the methods of the present invention, monopole feed 50 is connected to a transmitter-receiver pair 13, 15 that operates in a first frequency band and the quadrifilar helix antenna feed 30 is connected to a transmitter-receiver pair that operates in a second frequency band. These frequency bands may be widely separated. Additionally, the impedance of the quadrifilar helix antenna 20 may be matched to the impedance of one or both of the antenna feeds 30, 50. As discussed above, this may be accomplished via a variety of different impedance matching networks 60, 70.

EXAMPLE 1

An antenna system 18 has been constructed according to the teachings of the present invention for operation in the 824 MHz to 894 MHz AMPS frequency band and in the 1525 MHz to 1660 MHz frequency Asian Cellular Satellite System frequency band. In this embodiment of the present invention quadrifilar helix antenna 20 is designed as a $3\lambda/4$ wavelength antenna (where $\lambda$ is the wavelength corresponding to 1590 MHz) which is approximately 0.5" in diameter and 4.5" in length. Two narrow-band baluns 37, 39 were included in quadrifilar helix antenna feed circuit 30. The quadrifilar helix feed was matched to quadrifilar helix antenna 20 (which had an impedance of approximately 12 ohms) via 22 ohm inductive reactances 61, 63, 65, 67 which were implemented in series with each of antenna elements 22, 24, 26, 28 and via 0.036 mhos of capacitance susceptance 62, 64, 66, 68 which were implemented in parallel to each antenna element 22, 24, 26, 28. In this example, the series inductance was provided by slightly extending the length of each of the radiating elements 22, 24, 26, 28, and the shunt capacitance was implemented using lumped element components.

A second impedance matching circuit 70 was also provided for matching the impedance of monopole antenna feed 50 with the impedance of antenna 20. This circuit comprised a 3.9 pF lumped element capacitor 72 which was placed in series with the monopole impedance and a 6.8 pF lumped element capacitor 74 which was implemented in shunt. This implementation provides a VSWR of 2:1 over a 30 MHz range, and a VSWR of 3:1 or better over a 50 MHz range. Moreover, it is believed that significantly greater bandwidth may be achieved by designing the baluns to have a higher reactance in the band of monopole operation.

In this embodiment of the present invention, both quadrifilar helix antenna 20 and all the associated feed and matching circuits were implemented on a thin flexible microwave substrate material which was etched, plated, and then rolled into a cylindrical shape to form antenna 20.

In the drawings, specification and examples, there have been disclosed typical preferred embodiments of the invention and, although specific terms are employed, these terms are used in a generic and descriptive sense only and not for purposes of limitation, the scope of the invention being set forth in the following claims. Accordingly, those of skill in the art will themselves be able to conceive of embodiments of the dual mode antenna systems, radiotelephones and associated methods of operation other than those explicitly described herein without going beyond the scope of the present invention.

What is claimed is:

1. An antenna system for transmitting electrical signals, comprising:

a quadrifilar helix antenna having four radiating elements, wherein said quadrifilar helix antenna is configured to operate in a helical radiation mode and a monopole radiation mode;

a phase quadrature antenna feed coupled to said quadrifilar helix antenna for exciting said radiating elements in phase quadrature; and an in-phase antenna feed, separate from said phase quadrature antenna feed, coupled to said quadrifilar helix antenna for exciting said radiating elements in-phase; and second matching means coupled to the elements of said quadrifilar helix antenna for matching the impedance of said quadrifilar helix antenna to the impedance of said in-phase antenna feed; and wherein said quadrifilar helix antenna operates in a helical radiation mode when excited by said phase quadrature antenna feed and operates in a monopole radiation mode when excited by said in-phase antenna feed.

2. The antenna system of claim 1, further comprising four reactances which electrically connect the origin of each of said radiating elements to a common node.

3. The antenna system of claim 1, wherein the potential at said common node resulting from a signal provided to said quadrifilar helix antenna via said phase quadrature antenna feed is zero.

4. The antenna system of claim 1, further comprising first matching means coupled to the elements of said quadrifilar helix antenna for matching the impedance of said quadrifilar helix antenna to the impedance of said phase quadrature antenna feed.

5. The antenna system of claim 1, wherein said second matching means comprises one or more reactive components, and wherein said phase quadrature antenna feed operates as one of these reactive components.

6. The antenna system of claim 1, wherein said second matching means comprise a first capacitance in parallel to said in-phase antenna feed and a second capacitance in series to said in-phase antenna feed.

7. The antenna system of claim 1, further comprising a microelectronic substrate, and wherein said quadrifilar helix antenna, said phase quadrature antenna feed and said in-phase antenna feed are implemented on said microelectronic substrate.

8. The antenna system of claim 1, wherein said quadrifilar helix antenna operates in the helical radiation mode over one range of frequencies and operates in the monopole radiation mode over a second range of frequencies.

9. The antenna system of claim 1, in combination with a radiotelephone having:

a transmitter;

a receiver; and a user interface.

10. An antenna system for transmitting electrical signals, comprising:

a quadrifilar helix antenna having four radiating elements;

a first antenna feed coupled to said quadrifilar helix antenna for exciting said radiating elements in phase quadrature;

a second antenna feed coupled to said quadrifilar helix antenna for exciting said radiating elements in-phase; and an inductance coupled in series with each of the elements of said quadrifilar helix antenna and a capacitance coupled in parallel with each of the elements of said quadrifilar helix antenna; and wherein said quadrifilar helix antenna operates in a helical radiation mode when excited by said first antenna feed and operates in a monopole radiation mode when excited by said second antenna feed.

11. The radiotelephone of claim 10, wherein said parallel capacitances comprise four helical radiating elements which are electrically coupled at their origins and which are positioned adjacent to the radiating elements of said quadrifilar helix antenna.

12. The radiotelephone of claim 10, wherein said parallel capacitances comprise at least one lumped element capacitor in parallel to each of said radiating elements.

13. An antenna system for transmitting electrical signals in two separate frequency bands, comprising:

a quadrifilar helix antenna having four radiating elements;

a phase quadrature antenna feed coupled to said quadrifilar helix antenna for providing electrical signals in said first frequency band to and from said radiating elements in phase quadrature;

an in-phase antenna feed, separate from said quadrature phase antenna feed, coupled to said quadrifilar helix antenna for providing electrical signals in said second frequency band to and from said radiating elements in-phase;

a reactive network coupled in shunt to the elements of said quadrifilar helix antenna for matching the impedance of said quadrifilar helix antenna to the impedance of said phase quadrature antenna feed; and second matching means coupled to the elements of said quadrifilar helix antenna for matching the impedance of said quadrifilar helix antenna to the impedance of said in-phase antenna feed.

14. The antenna system of claim 13, wherein said second matching means comprise a capacitance in series with said in-phase antenna feed and an inductance connected in parallel.

15. The antenna system of claim 14, wherein said phase quadrature antenna feed comprises a coaxial transmission line coupled in phase quadrature to each of said radiating elements via a 90° hybrid coupler and wherein said series inductance comprises a portion of said coaxial transmission line.

16. The antenna system of claim 13, wherein the impedance associated with the components comprising said phase quadrature antenna feed is coupled in series to said in-phase antenna feed.

17. A method of transmitting electrical signals using an antenna system which includes a quadrifilar helix antenna having four radiating elements and configured to operate in a helical radiation mode and a monopole radiation mode, an in-phase antenna feed coupled to the quadrifilar helix antenna and a phase quadrature antenna feed coupled to the quadrifilar helix antenna, the method comprising the steps of:

(a) exciting the quadrifilar helix antenna through the phase quadrature antenna feed to operate in a helical radiation mode;

(b) exciting the quadrifilar helix antenna through the in-phase antenna feed to operate in a monopole radiation mode; and (c) matching the impedance of the quadrifilar helix antenna to the impedance of the in-phase antenna feed when operating in the monopole radiation mode.

18. The method of claim 17, further comprising the step of matching the impedance of the quadrifilar helix antenna to the impedance of the phase quadrature antenna feed when operating in the helical radiation mode.

* * * * *